US006779747B2

(12) United States Patent
McLean et al.

(10) Patent No.: US 6,779,747 B2
(45) Date of Patent: Aug. 24, 2004

(54) INTELLIGENT DOCUMENT SHREDDER DEVICE

(75) Inventors: Brent J. McLean, Cupertino, CA (US); Tim M. Hoberock, Bois, ID (US); Leslie G. Murray, Marsing, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 324 days.

(21) Appl. No.: 09/995,476

(22) Filed: Nov. 27, 2001

(65) Prior Publication Data

US 2002/0070300 A1 Jun. 13, 2002

Related U.S. Application Data

(63) Continuation-in-part of application No. 09/556,765, filed on Apr. 24, 2000, now abandoned.

(51) Int. Cl.[7] ..... B02B 1/00; B02C 1/00

(52) U.S. Cl. ..... 241/30; 241/34; 241/37; 241/236

(58) Field of Search ..... 241/30, 34, 36, 241/37, 236

(56) References Cited

U.S. PATENT DOCUMENTS 4,657,192 A * 4/1987 Browning ..... 241/224
4,957,243 A * 9/1990 Kanagaki et al. ..... 241/34
5,354,001 A * 10/1994 Hasegawa ..... 241/34
5,649,627 A * 7/1997 Wako ..... 209/534
5,961,058 A * 10/1999 Kroger ..... 241/236

* cited by examiner

*Primary Examiner*—Mark Rosenbaum
(74) *Attorney, Agent, or Firm*—Leslie G. Murray

(57) ABSTRACT

A method for shredding a document which renders the information unintelligible and prevents or minimizes reassembly of the shredded document reconstruction of the information contained in the document. The ability to reassembly a shredded document is greatly reduced by shredding each page of the document into segments formed by cuts made in the blank space between characters or images on the page. A cut pattern in which all cuts are made in the blank spaces between characters or images produces pieces or shreds of the document which have no partial or portions of characters or marks which can be matched across adjacent pieces. A document is first scanned to provide an image which can be analyzed by a processor to determine a desired cut pattern for the document. The processor then generates a set of instructions to control and adjust the cutting blades in a shredding device to cut the document in the desired cut pattern.

33 Claims, 8 Drawing Sheets

INTELLIGENT DOCUMENT SHREDDER DEVICE

This application is a continuation-in-part of U.S. patent application Ser. No. 09/556,765 filed on Apr. 24, 2000, now abandoned.

FIELD OF THE INVENTION

The present invention relates generally to a disposal or shredder apparatus for paper and other information carrying media for the disposal of documents containing sensitive information, and, more particularly, relates to a shredder device for shredding documents in a manner which minimizes or prevents the recovery and reconstruction of information from the shredded documents.

BACKGROUND OF THE INVENTION

It is well known to provide an apparatus to destroy documents to preserve the confidentiality of the information contained in the documents. Present day devices for shredding or otherwise destroying documents for security purposes are known as "paper shredders" or just simply, "shredders."

Shredders are widely used for the disposal of documents containing sensitive information. Conventional shredders attempt to ensure the security of information by cutting or tearing documents into narrow strips or small segments to thus render the information contained in the documents illegible. While recovery and reconstruction of information from such shredded documents is difficult and time-consuming, by employing various forms of presently available technological and manual techniques, it can be accomplished.

For the more common types of shredders in use today, reconstruction of information is not overly difficult because the strips of shredded documents fall into a waste receptacle in roughly the same sequence and proximity as they were prior to being shredded. Further, the strips of a particular shredded document may also be cut at a preferred angle or slant resulting from feeding the document to the shredder at an angle. Of course, the finer the shredding, i.e., the smaller the resulting segments of shredded document are, the more difficult it is to reconstruct the information contained in the document. Additionally, and the most helpful in the reconstruction process, most, if not all, shredders in use today create cuts which traverse a portion of a character or other image on the document. It is then a relatively simple matter to connect or match one portion of an image on one strip or segment of the document to a corresponding portion of the image appearing on another strip or segment of the document. For example, the top portion of the letter "A" to the bottom portion of that same letter.

It is clear that most document shredders in use today do not provide adequate destruction of documents to prevent reconstruction of the information contained in the shredded documents in the face of a determined effort. What is needed then is a document shredder device which intelligently shreds or otherwise destroys documents in such a manner that no information can be reconstructed from the shredded document material.

SUMMARY OF THE INVENTION

In a preferred embodiment, the present invention provides a method for shredding a document which cuts each page of the document into segments formed by cuts made in the blank space between characters or images on the page. Since the document segments do not have any partial images or characters at the edges, corresponding or adjacent segments cannot be matched thus preventing or, at least, greatly increasing the difficulty of reconstructing information from the shredded document material. A document shredder embodying the present invention is simple to use and provides secure disposal of proprietary and sensitive material.

In a preferred embodiment, the present invention is implemented as a method for shredding a document including analyzing the text or image printed on each page of the document to determine a desired cut pattern for shredding the document into segments. Preferably, the desired cut pattern positions all cuts in the blank space separating characters or groups of characters on the document page. That is, all cuts occur within blank space on the document page. The cutting position of one or more cutting devices is adjusted such that all cuts on the document page are made in accordance with the desired cut pattern. Each document page is then shred or cut into segments in accordance with the desired cut pattern.

In another preferred embodiment, a document shredder implementing the present invention includes a document reader to provide an image of the information contained on the pages of the document. Preferably the document reader is a scanner which provides a digital image of the document. A processor coupled to the document reader analyzes the image corresponding to each page to determine the desired cut pattern for that page. Preferably, the desired cut pattern thus determined will allow cuts only in the blank spaces on the page between characters or groups of characters in the text. In another preferred embodiment, the desired cut pattern may allow one cut per document segment to traverse or cut across a character or portion of a character. Instructions generated by the processor are coupled to adjustable cutting components to adjust the size and position of cuts in the document to shred the document into segments in accordance with the desired cut pattern.

Other embodiments and advantages of the present invention will be readily appreciated as the same become better understood by reference to the following detailed description, taken in conjunction with the accompanying drawings. The claims alone, not the preceding summary or the following detailed description, define the invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the following detailed description illustrate by way of example the principles of the present invention. The components in the drawings are not necessarily to scale, emphasis instead being placed upon clearly illustrating the principles of the present invention. In the drawings like reference numbers indicate identical or functionally similar elements throughout the several views thereof, and wherein.

DETAILED DESCRIPTION OF THE INVENTION

Figure 1A:
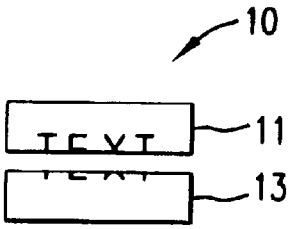
FIGS. 1A, 1B and 1C are diagrams illustrating the principles of the present invention.

As shown in the drawings for purposes of illustration, the present invention is preferably embodied in a method for shredding a document which shreds each page of the document into segments formed by cuts made in the blank space between characters or images on the page. A document shredder embodying the present invention provides a shredded document for which corresponding or adjacent segments cannot be matched thus preventing or, at least, greatly increasing the difficulty of reconstructing information from the shredded document material.

Most document shredders in use today do not provide adequate destruction of documents to prevent reconstruction of the information contained in the shredded documents in the face of a determined effort.

Figure 1C:
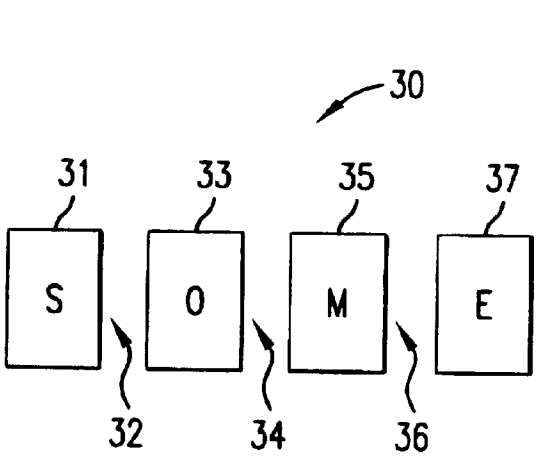
Figure 1B:
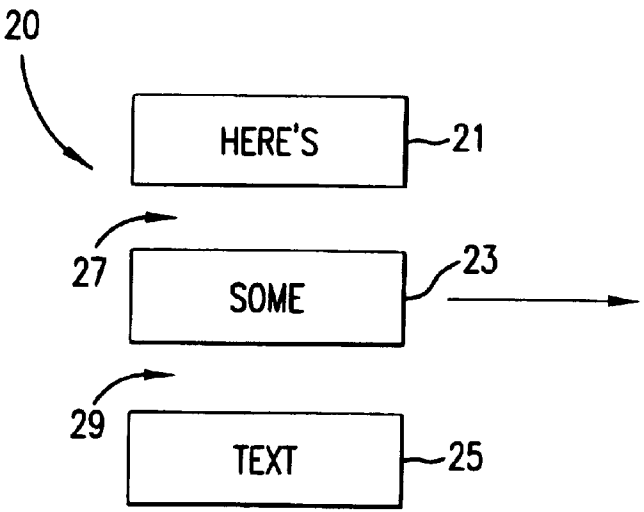

FIGS. 1A, 1B and 1C are diagrams illustrating the principles of the present invention. Most document shredders commonly in use today employ the same method or scheme to shred every document. The conventional home or office shredder shreds a document into relatively large strips, dumping the shredded material in a disposal bin in near-perfect order. Additionally, the cuts forming the strips will cut across or traverse characters or groups of characters or other images making up the text and other information in the document. For example, as shown in FIG. 1A, consider the word "TEXT" 10 separated into two strips 11 and 13 with the cut traversing the entire word 10. Since portions of each character are at opposing edges of the strips 11 and 13, the bits can be easily matched across the cut and the strips 11, 13 reassembled, and it is a simple matter to reconstruct the information. Thus a cut such as illustrated in FIG. 1A is no better than no cut at all.

In a preferred embodiment of the present invention, a document is analyzed to determine an optimal or desired cut pattern prior to shredding the document. The desired cut pattern may be one in which all cuts are in blank spaces on the document page; i.e., a cut between characters, groups of characters or other images where the page is blank. For example, as shown in FIG. 1B, the text "HERE'S SOME TEXT" 20 has been cut or shredded into three rectangular shreds or pieces 21, 23 and 25. The cuts 27 and 29 separating the pieces 21, 23 and 25 are made entirely within blank spaces with no portion of the characters on the pieces being traversed by the cut. Thus there are no bits or portions of any character at the edges of opposing sides of the pieces which can be recognized or matched and reconstruction of the information in the document becomes much more difficult. If the edges of two adjacent shreds or pieces of the document do not have any images, they can not be matched together. Similarly, as shown in FIG. 1C, the word "SOME" 30 is cut or shredded into four pieces 31, 33, 35 and 37, each piece having only a single character of text. The cuts 32, 34 and 36 separating the pieces 31, 33, 35 and 37 are made entirely within blank spaces with no portion of the character on the pieces being traversed by the cut. In the optimal case, each shred or piece of document having only one character or a small number of characters, no more than two or three, for example, the document is basically reduced to random characters with no indication or suggestion how to reassemble the document or reconstruct the information.

Figure 2B:
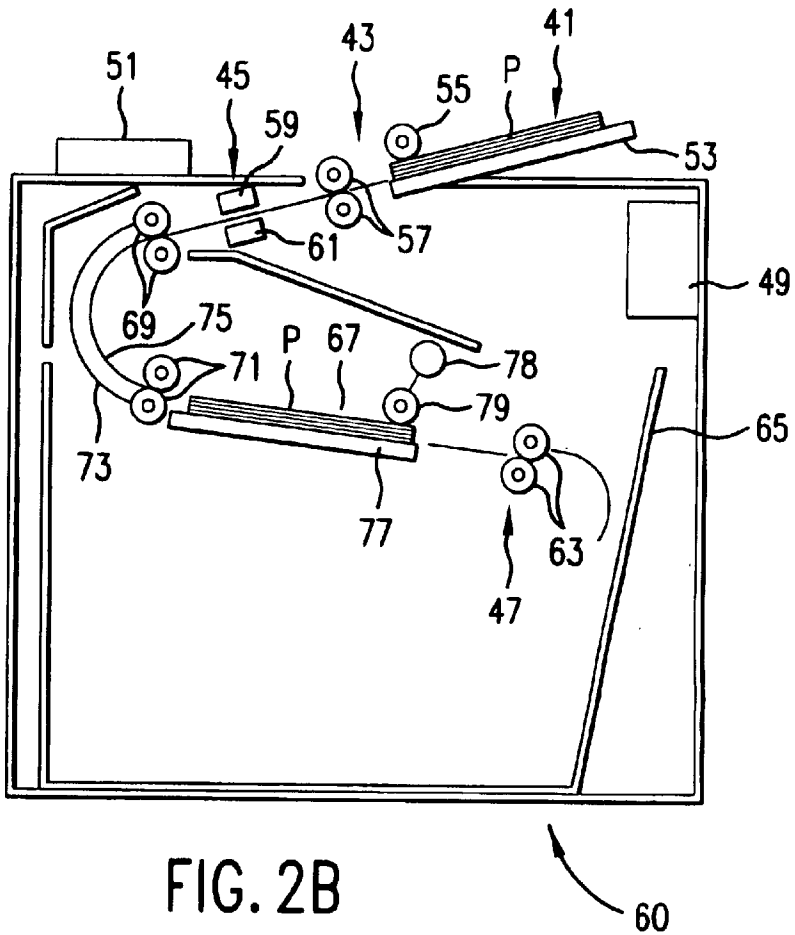
FIGS. 2A and 2B are diagrams showing the overall structure of two embodiments of a document shredder according to the principles of the present invention.
Figure 2A:
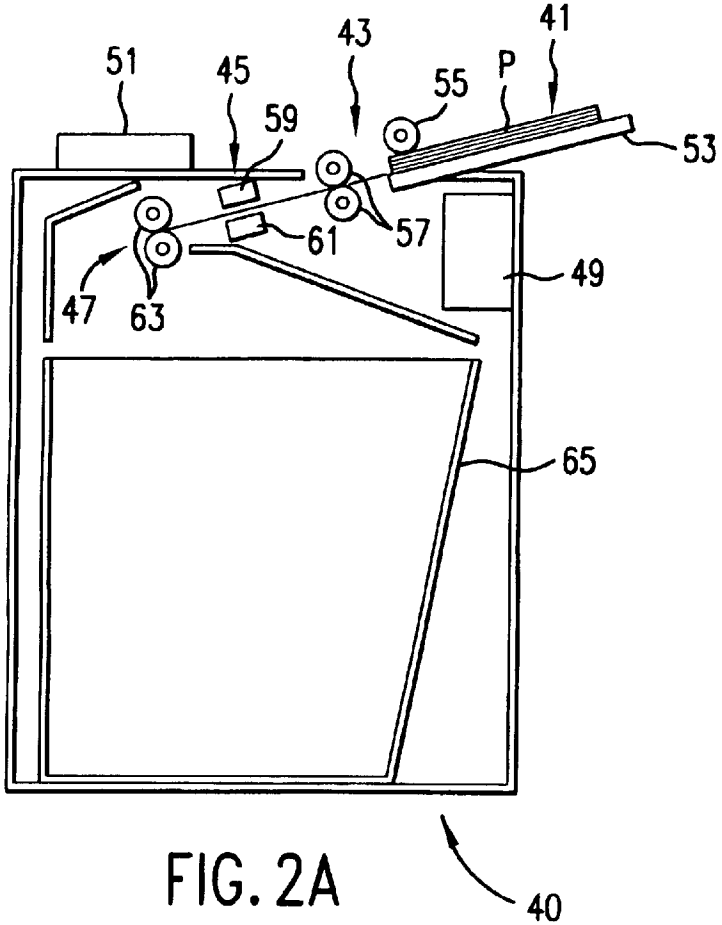

Referring now to FIG. 2A, a preferred embodiment of a document shredder for disposing of information carrying media such as paper documents is shown. While it is recognized that documents can be of various materials such as paper, cardboard, plastic or the like, for example, for the purposes of the following detailed description, the document shredder of the present invention will be explained in the context of paper media. The document shredder 40 includes an automatic paper feed input tray 41, a paper or page feeder roller unit 43, an information readout or reader unit 45, a media shredding unit 47, an image processing unit 49, and an operation control panel 51.

A document to be shredded is placed on a paper feed table 53 in the automatic paper feed input tray 41. In the input tray 41, each sheet of paper or page P is separated from a stack of pages making up the document by a feed out roller 55 and is fed, page by page, to the paper feed roller unit 43. The paper feed roller unit 43 includes a pair of paper feed rollers 57 which are driven at a prescribed rotational speed and each page or sheet of paper P from the input tray 41 is fed to the information read out or reader unit 45 at a prescribed feed speed.

The information reader unit 45 may be any conventional image reader capable of reading the information on each page of the document and converting the image to an analog or digital form, such as a flat bed or line scanner, or a digital camera, for example. In the preferred embodiment of FIG. 1A, the information reader unit 45 includes CCD line sensors 59 and 61. The CCD line sensor 59 is fixedly placed in such position as to scan the information printed on the front face or upper side of the document page P fed by the paper feed roller unit 43, and the CCD line sensor 61 is fixedly placed in such a position as to read the information printed on the back face or underside of the page P fed by the paper feed roller unit 43.

As will be described in more detail with reference to FIG. 3, the information processing unit 49 includes a processor 491 for analyzing the image generated by the document reader 45, a memory or storage unit 493 and a shredder control unit 495.

The media shredding unit 47 is positioned downstream of the information reader unit 45 with respect to the feed direction of the paper P by the paper feed roller unit 43, and receives pages or sheets of paper which have been passed through the information reader unit 45. The media shredder unit 47 is provided with a structure similar to that of a conventional shredder, and includes one or more cutting components 63. The cutting components 63 are adjustable to shred or cut the pages of the document into pieces having a desired size and shape. In a preferred embodiment, the cutting components 63 include a pair of rotatively driven cutter rotors wherein the spacing between cutter blades is adjustable to shred the paper P into strips having different widths. As explained below with reference to FIGS. 2C and 2D, the media shredder unit 47 may also include one or more cutter blades 64 to facilitate shredding the paper P into short pieces having different widths. The length of the short pieces may also be varied by varying the input or feed speed of the documents to the shredder.

Below the document shredding unit 47 is placed a shredded paper storage box or bin 65 for storing the shredded pieces of paper produced by shredding the paper P in the media shredder unit 47. Conventionally, the storage bin 65 is removable to allow the shredded document material to be recycled, burned or otherwise disposed of.

The operation control panel 51 incorporates various manual controls (not shown) required to operate the document shredder 40. The operation control panel 51, for example, includes a power switch, a start/stop key, a shredding mode selection key, a single side mode selection key, a security mode selection key, and the like. The control panel may also include a key-pad (not shown) for entering a password. The operation control panel 51 is coupled to the information processing unit 49 and to various other components as required to control the operation of the document shredder 40.

Referring now to FIG. 2B, another preferred embodiment of a document shredder for disposing of information carrying media such as paper documents is shown. The document shredder 60 is similar in structure to document shredder 40 as described above with reference to FIG. 2A, and includes an automatic paper feed input tray 41, a paper or page feeder roller unit 43, an information readout or reader unit 45, a media shredding unit 47, an image processing unit 49, and an operation control panel 51.

In this embodiment, the document shredder 60 includes a shredder input tray 67 which receives document pages after they have passed through the information reader unit 45 and temporarily stores them until the document pages are to be fed to the media shredding unit 47. The document shredder 60 also incorporates an upper pair of rollers 69 and a lower pair of rollers 71 separated by a paper guide 73. The paper guide 73 reverses the paper path between the information reader unit 45 and shredder input tray 67 while the rollers 69, 71 feed the paper P along paper path 75 from the information reader unit 45 to the shredder input tray 67. The shredder input tray 67 includes a paper receiving table 77 and a paper feed out roller 79. In a preferred embodiment, paper feed out roller 79 is driven by a variable speed or stepper motor 78. Sheets of paper which have passed through the information reader unit 45 are stacked on the paper receiving table 91 to be fed to the media shredding unit 47 at a later time.

Referring now also to FIGS. 2C, 2D, 2E and 2F, in one preferred embodiment the media shredding unit 47 includes a pair of rotatively driven cutter rotors 63 wherein the spacing between cutter blades 631 is adjustable to shred the paper P into pieces having different widths. The paper P is directed along the paper path 75 between opposing cutter blades 631 where it is cut, or shredded, into strips length wise as it passes through the cutter rotors 63. The cutter blades 631 mesh and overlap slightly at the paper path 75 to ensure that the media, paper P, is cleanly cut as it passes between the cutter blades 631.

Figure 2C:
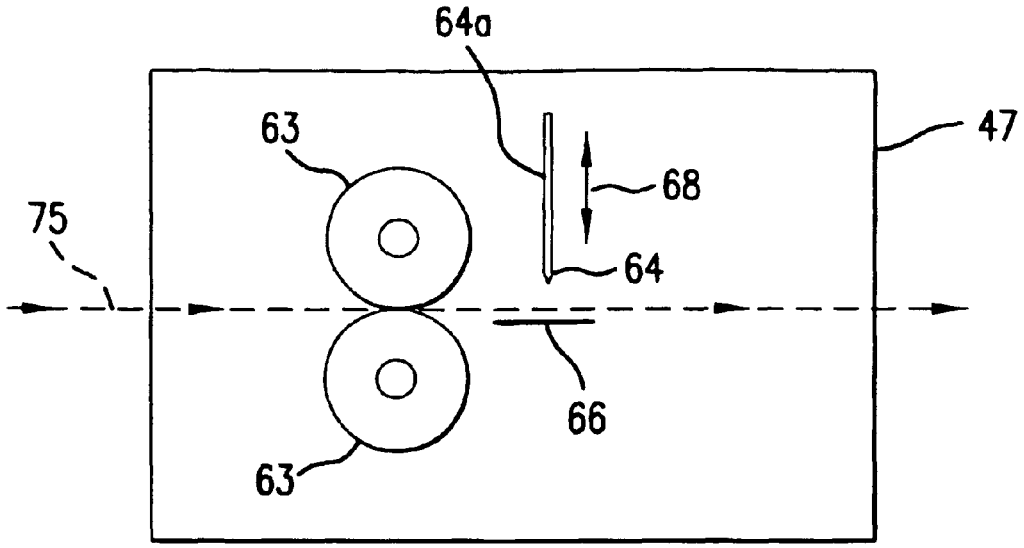
FIGS. 2C and 2D are diagrams illustrating the structure of two embodiments of an adjustable cutter assembly according to the principles of the present invention.
Figure 2D:
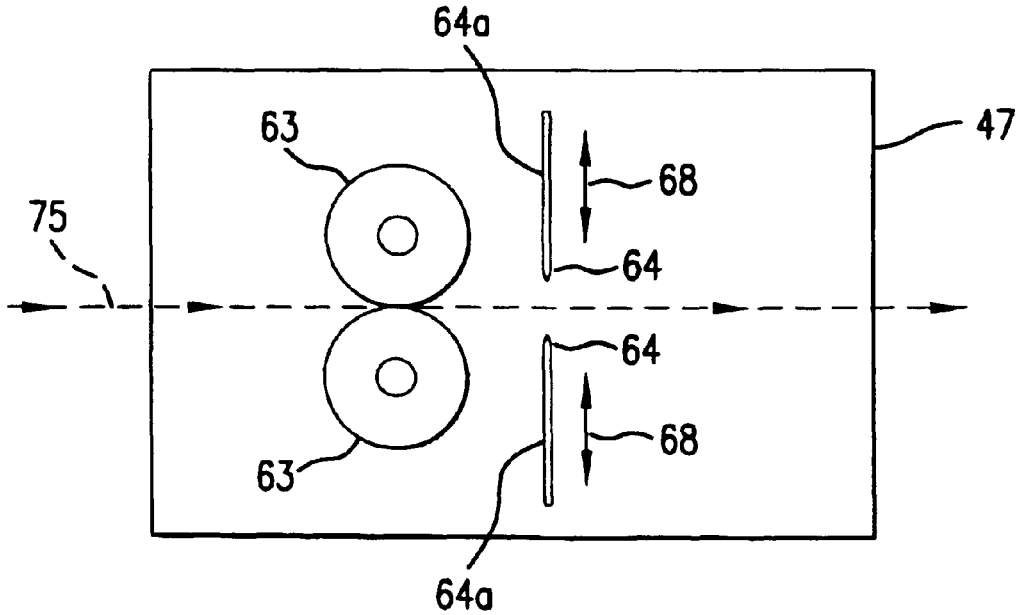

The media shredder unit 47 also includes one or more cutter blades 64 disposed downstream along the paper path 75 from the cutter rotors 63 to facilitate shredding the paper P into pieces having both different widths and different lengths. In a first embodiment as shown in FIG. 2C, a cutter blade 64 is mounted on a shaft 64*a* in a normal or vertical plane relative to the paper path 75. As shown by arrow 68, the cutter blade 64 is reciprocatively driven against a platen 66, the paper path 75 being directed between the cutter blade 64 and the platen 66. In a second embodiment as shown in FIG. 2D, a pair of opposing cutter blades 64 are mounted in the normal or vertical plane relative to the paper path 75, the paper path 75 being directed between the cutter blades 64. In a manner similar to that discussed with reference to FIG. 2C, each cutter blade 64 is mounted on shaft 64*a* and reciprocatively driven as shown by arrow 68. The opposing cutter blades 64 mesh and overlap slightly at the paper path 75 to cleanly cut the paper strips proceeding from the cutter rotors 63 into pieces. The length of each piece is determined by the input or feed speed of the paper to the media shredding unit 47. In one preferred embodiment, the input speed is varied by varying the rotational speed of the feed out roller 55 or of the feed out roller 79. In another preferred embodiment, the paper feed out roller 79, as shown in FIG. 2B, is rotatively driven by a separate variable speed motor 79. Alternatively, motor 79 may be a stepper motor rotatively driving the feed out roller 79 to index or advance the paper P through the media shredding unit 47 in adjustable discrete steps thus producing pieces of shredded paper having a desired length as well as a desired width.

Figure 2E:
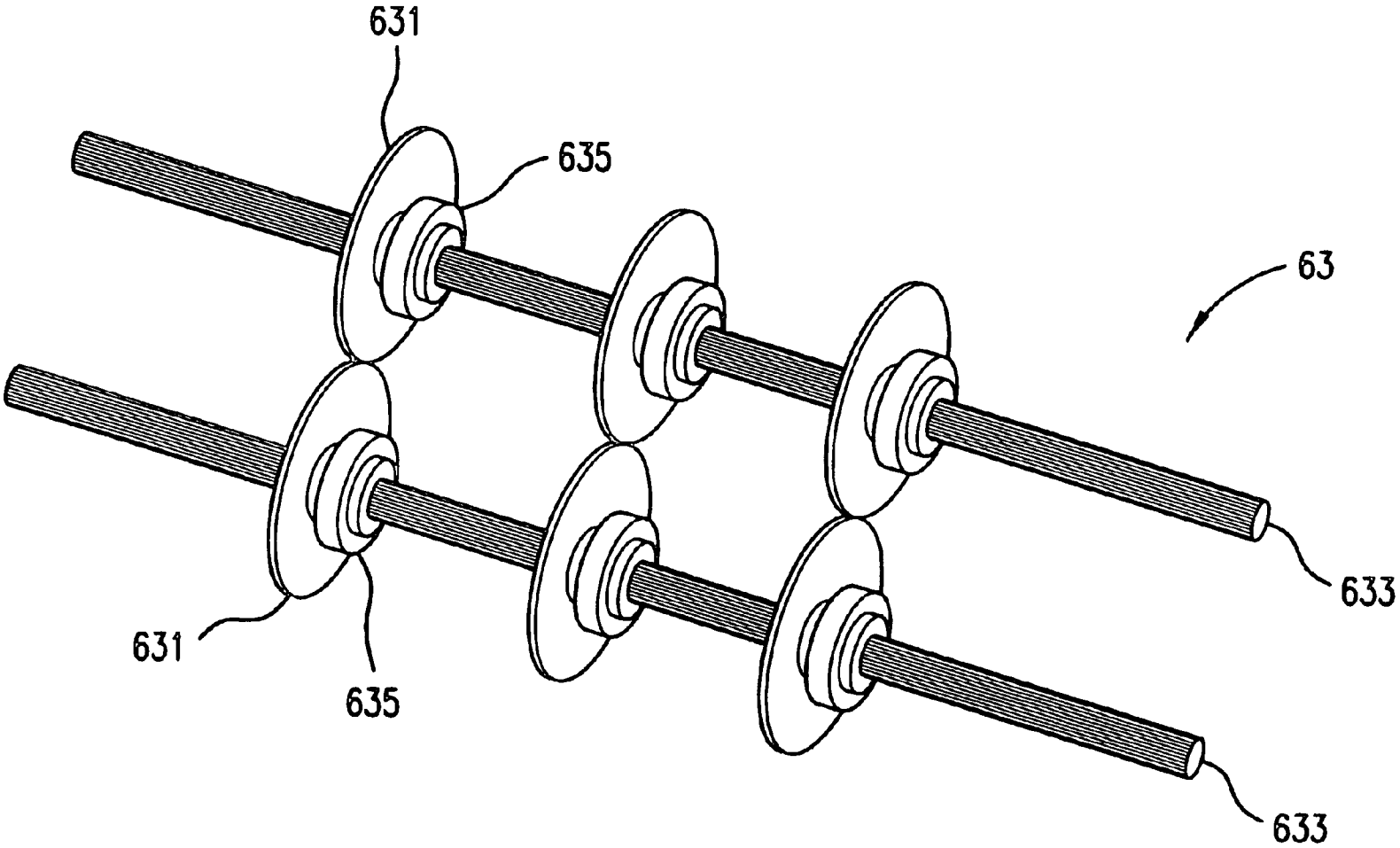
FIGS. 2E and 2F are diagrams illustrating the structure of two embodiments of adjustable cutter blades according to the principles of the present invention.
Figure 2F:
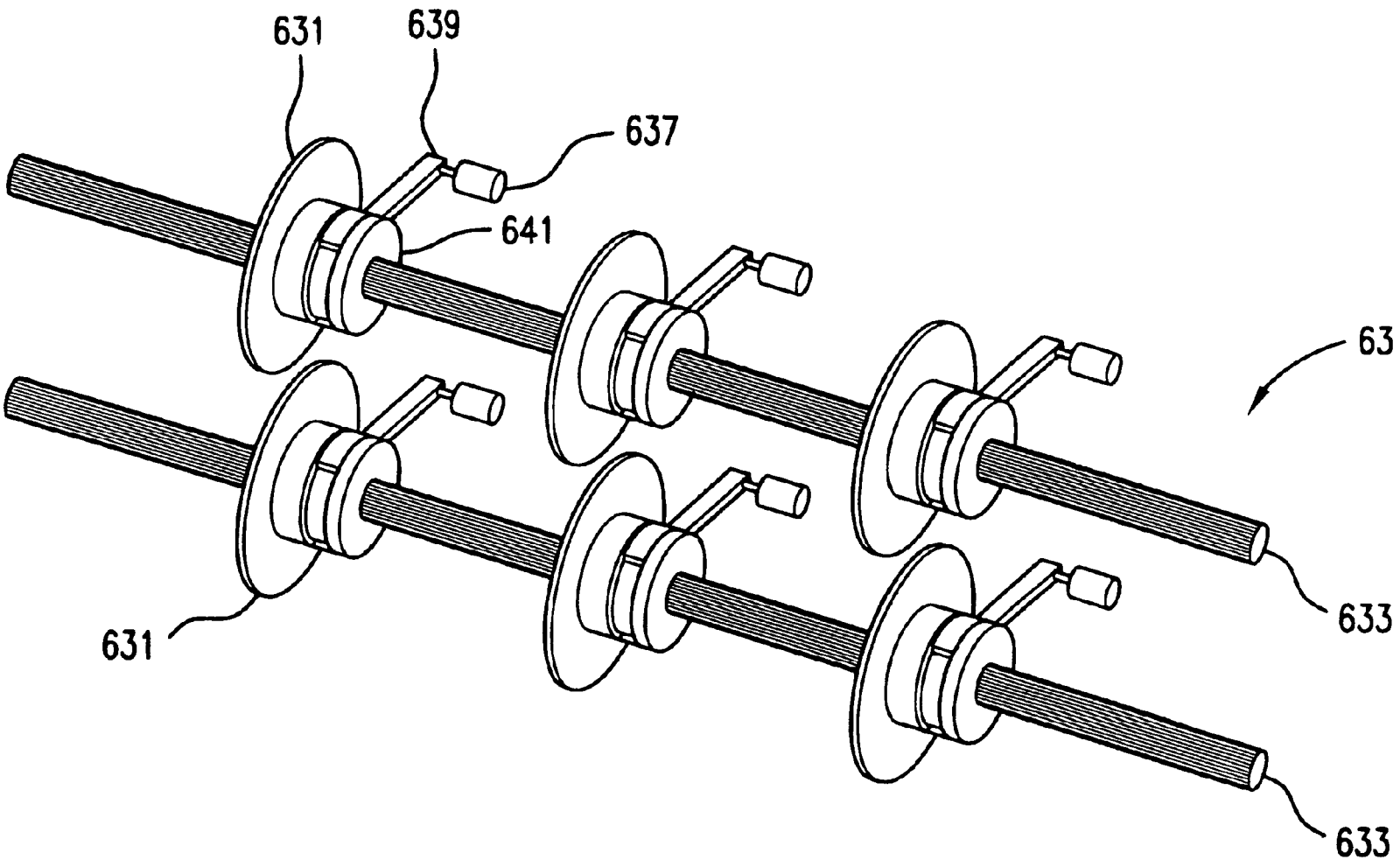

With continuing reference to FIGS. 2E and 2F, the cutting rotor 63 includes a number of cutting blades 631 slideably mounted on a shaft 633. The number of cutting blades 631 mounted on the shaft 633 is determined by the degree it is desired to shred a document; the greater the number of cutter blades, the more finely shredded a document will result. The shaft 633 is conventionally rotatively driven as is known in the art. In a preferred embodiment, the shaft 633 is splined or grooved to mesh with corresponding ridges in a aperture through each cutter blade 631. Alternatively, the shaft maybe smooth-surfaced and round or square as is known in the art. In one preferred embodiment, as shown in FIG. 2E, the position of each cutter blade 631 on the shaft 633 is adjustable by an electrical actuator or motor 635, the actuator 635 being mounted directly on or an integral component of the cutter blade 631. Thus, the position of each cutter blade 631 may be individually adjusted providing varying distances between pairs of cutter blades 631 mounted on the shaft 633. Generally, the cutter rotors 63 are mounted in pairs, as shown in FIGS. 2C and 2D, the positions of corresponding, opposing, cutter blades 631 on each shaft 633 being adjusted an appropriate amount to ensure the that opposing cutter blades mesh and overlap. In another preferred embodiment, as shown in FIG. 2F, the position of each cutter blade 631 on the shaft 633 is adjustable by an electrical actuator 637, such as a solenoid, mechanically coupled to the cutter blade 633 via a rigid arm or fork 639. The fork 639 meshes with the corresponding cutter blade 631 via a collar 641 mounted on or an integral part of the cutter blade 633. As discussed below with reference to FIG. 3, the electrical actuator 635 or 637 for each cutter blade 631 is responsive to a control signal generated by shredder control unit 495. As opposing cutter blades 631 on paired shafts 633 are required to be meshed, the electrical actuators 635 or 637 associated with opposing cutter blades may be electrically ganged together. Alternatively, the electrical actuators 635 or 637 associated with opposing cutter blades 631 may each receive separate control signals.

Figure 3:
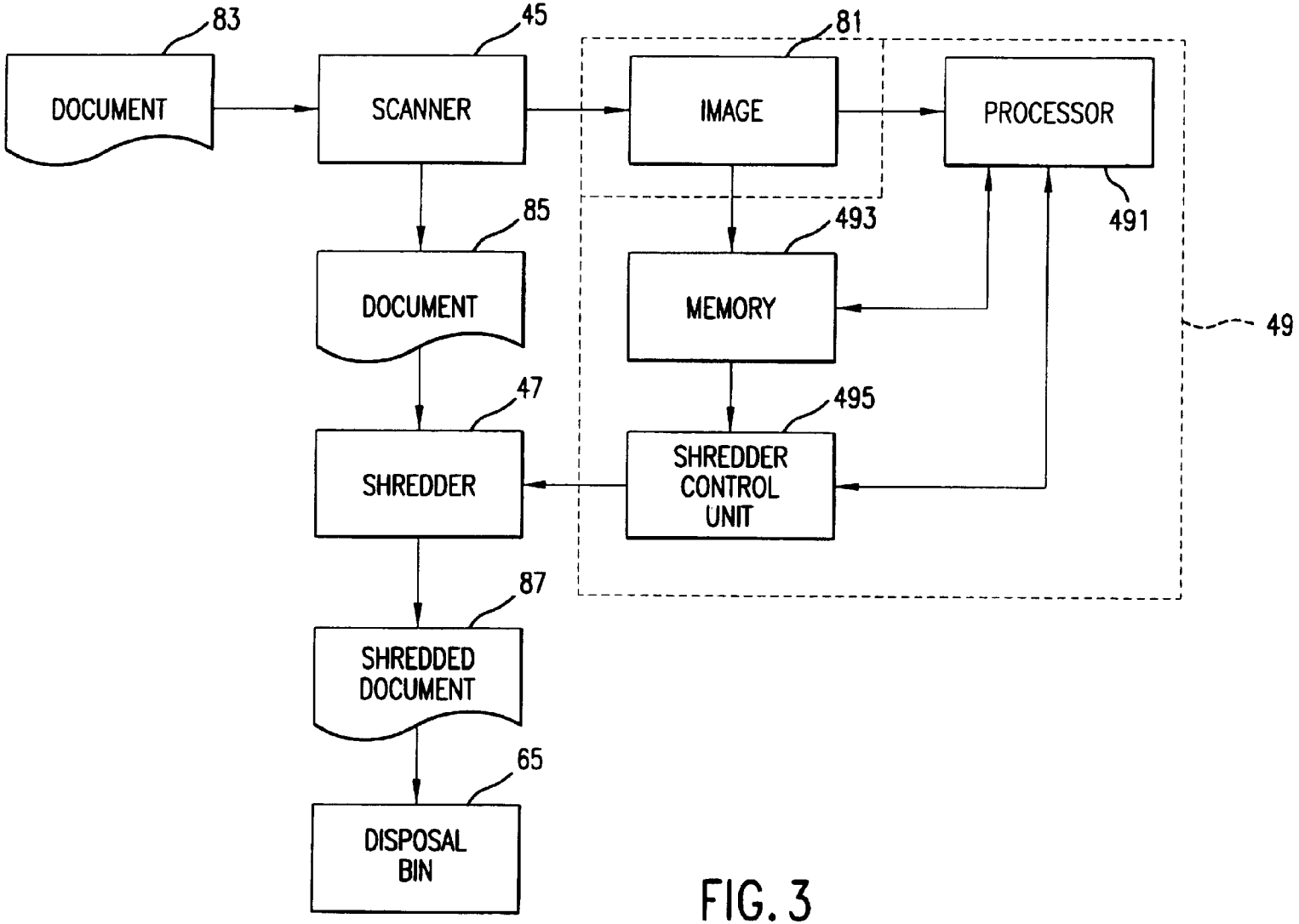
FIG. 3 is a block diagram showing an embodiment of a document shredder according to the principles of the present invention.

Referring now also to FIG. 3, the information processing unit 49 includes a processor 491, a memory or storage unit 493 and a shredder control unit 495. The processor 491 analyzes an electronic image 81 generated by the document reader 45 to determine a desired cut pattern as described above with reference to FIGS. 1B and 1C. The memory unit 493 stores various instruction sets and algorithms for use by the processor 491. The memory unit 493 may also temporarily store one or more pages of the electronic image 81, and various outputs of the processor 491. The shredder control unit 495 controls the operation of the media shredding unit 47 in accordance with instructions generated by the processor 491 to shred the document pages in the desired cut pattern as determined by the processor 491. The shredder control unit 495 may also control the speed or rate at which document pages P are fed to the information reader unit 45 from the automatic paper feed input tray 41, and to the media shredding unit 47 from the shredder input tray 67. The shredder control unit 495 may also control the media shredding unit 47 in accordance with operator input via the operation control panel 51.

Figure 4:
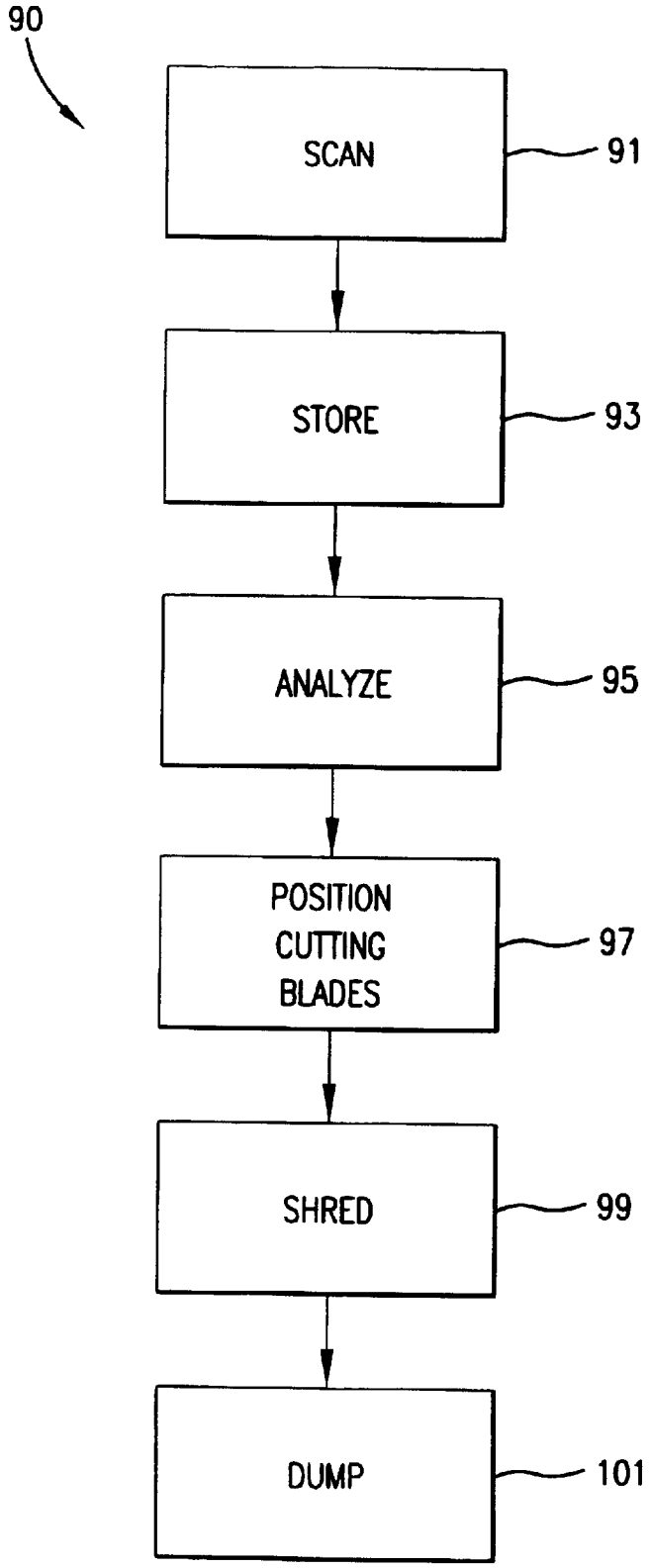
FIG. 4 is a flow chart illustrating a preferred embodiment of a document shredder according to the principles of the present invention.

Referring now to FIG. 4 and with continuing reference to the FIG. 3, to initiate operation of the document shredder according to the present invention, an operator places a document 87 to be shredded in the automatic paper feed input tray 41 and then starts the shredding process 90 (as shown in FIG. 4) at the operation control panel 51. In a preferred embodiment, prior to starting operation of the document shredder 40, the operator may be able to input selected document characteristics, such as media type and weight, single-sided/double-sided, desired security level, and the like.

When the shredding process 90 is started, the paper feed input tray 41 feeds the first page of the document 83 to the information reader unit 45. At the information reader unit 45, each page of the document 83 is scanned or otherwise read (step 91) and an electric signal representing an electronic image 81 of the document printed page is generated. In a preferred embodiment, the electronic image 81 is a digital image 81. The electronic image 81 is stored (step 93) in memory 493 until the image 81 is complete and then is couple to the processor 491 to be analyzed (step 95). Alternatively, the image 81 may be stored at the information reader unit 45 until a document page is read and the complete page image coupled directly to the processor 491. At the processor 491, the image 81 is analyzed to determined a desired cut pattern for the media shredding unit 74 in accordance with a predetermined set of rules. If the document to be shredded is complex, such as double-sided, for example, the optimal cut pattern as described above with reference to FIGS. 1B and 1C (i.e., all cuts in blank space on each page) may not be achievable and one or more cuts on the document page may traverse a character or other printed image. In one preferred embodiment, the set of rules for analysis may specify that the pieces by rectangular-shaped and allow up to one cut per each rectangular piece or shred of the shredded document to traverse a character or portion of a character, for example. In another embodiment, the number of cuts per document page which traverse a character or portion of a character may not exceed an adjustable predetermined limit; the predetermined limit may be set by the operator as a desired security level prior to initiating the shredding process.

When the processor 491 completes the image 81 analysis for an entire page, a set of instructions is generated and coupled to the shredder control unit 495. The shredder control unit 495 adjusts (i.e., positions the shredder cutting components) the media shredding unit cutting blades (step 97) in accordance with the set of instructions generated by the processor 491. The read (scanned) document page 85 is then fed to the media shredding unit 47 to be shredded (step 99) in accordance with the desired cut pattern determined by the processor 491 for that document page. The shredded document page 87 is them dumped to the disposal bin 65.

Figure 5:
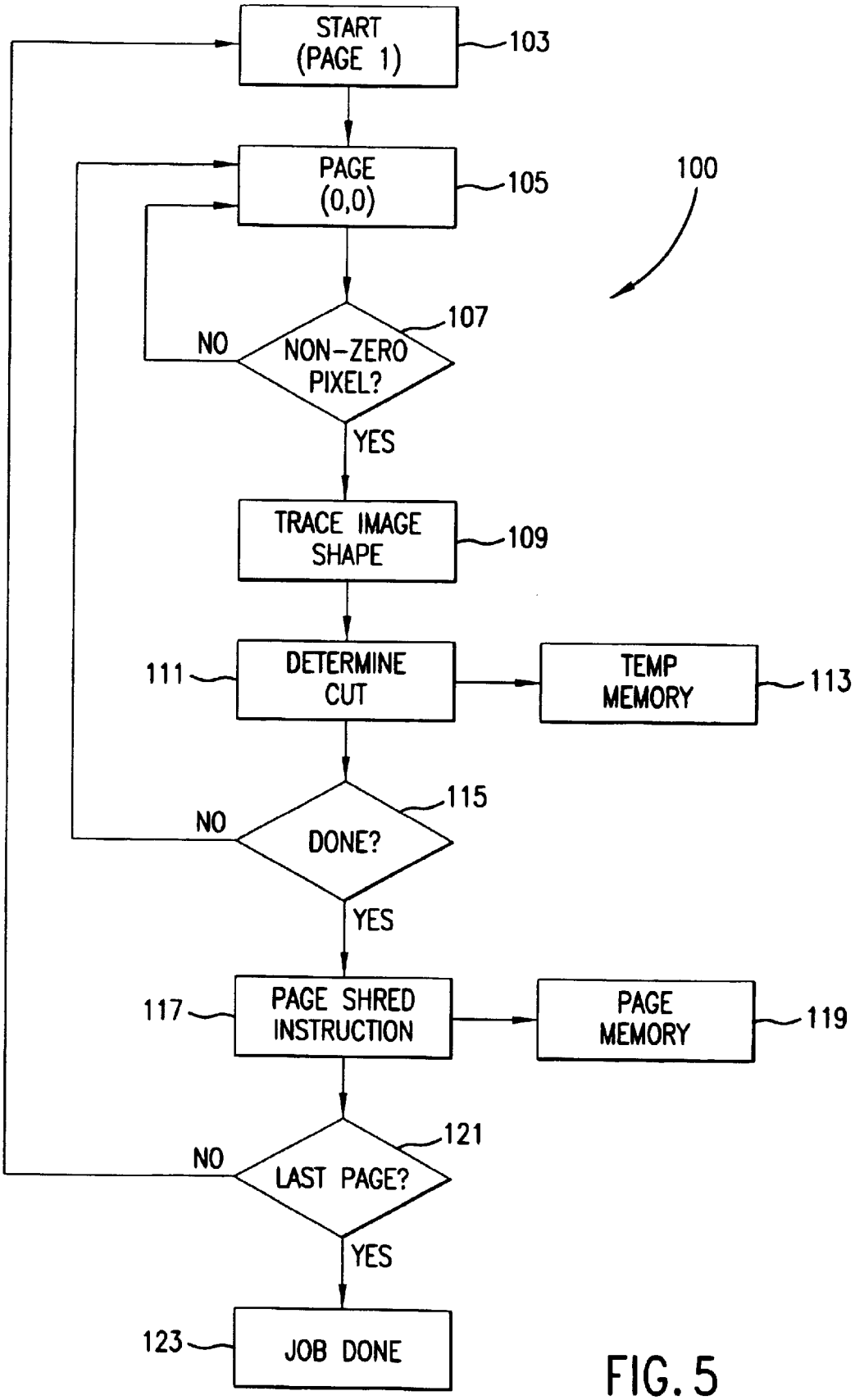
FIG. 5 is a flow chart illustrating a preferred embodiment of the document image analysis according to the principles of the present invention.

Referring now also to FIG. 5, a preferred page image analysis process 100 is shown. Starting with the first page of the document (step 103), scan the page in a file format to provide a page image, preferably digital, from which the individual image pixels can be accessed and store the image in memory. Using a predetermined position on the page, such as the upper left-had corner, (0,0) in a Cartesian coordinate system, for example, examine each pixel in order (step 105) to determine whether or not the pixel is non-zero (step 107). Preferably, a non-zero pixel will be a different color than the background color and indicates a mark (i.e., a bit or portion of a printed character or other image) on the page. If the pixel is not non-zero, then return to step 105 and increment by one pixel position. If the pixel under examination is non-zero, then trace (step 109) the image shape formed by the non-zero pixel and all adjacent non-zero pixels. Determine the cut (step 111) for the traced image shape by positioning a number of cuts surrounding the traced image shape, leaving several pixels of blank buffer space within the boundaries of the cut on all sides of the traced image. Preferably, the cuts will be vertical and horizontal cuts forming a rectangle around the traced image. If the cut is too large, subdivide the cut into further, smaller cuts. Whether or not a cut is too large, or too small, is a function of the complexity of the document being shredded and the criteria and rules specified by the operator. When the cut has been determined, it is stored in temporary memory (step 113) and it is determined whether or not the analysis for the first or current page is complete (step 115). If the current page is not complete, return to step 105 and increment to the next pixel position. The process 100 proceeds in this manner across and down the page until the analysis for the current page is complete. The cut determined for each traced image shape (step 111) may have to be iterated multiple times as the current page is analyzed to obtain the optimal or ideal cut pattern for the entire current page.

If the analysis for the first or current page is complete (step 115), recall all of the various cuts for the current page from temporary memory (step 113) and generate the instruction set (step 117) to obtain the desired cut pattern for the first or current page. The instruction set thus generated will be used by the shredder control unit 495 to adjust the cutting components of the media shredding unit 47 to shred the current page in the desired cut pattern for that page. The instruction set is then stored in a page memory (step 119) in the memory unit 493 and subsequently coupled to the shredder control unit 495 by the process 491 at the appropriate time. The current page is then checked for last page (step 121). If no, return to start (step 103) and increment the page number. If yes, the analysis is complete (step 123) and the processor 491 can proceed with the shredding of the document.

In addition to the foregoing, the logic of the present invention can be implemented in hardware, software, firmware, or a combination thereof. In the preferred embodiment(s), the logic is implemented in software or firmware that is stored in a memory and that is executed by a suitable instruction execution system. If implemented in hardware, as in an alternative embodiment, the logic can be implemented with any or a combination of the following technologies, which are all well known in the art: a discrete logic circuit(s) having logic gates for implementing logic functions upon data signals, an application specific integrated circuit (ASIC) having appropriate logic gates, a programmable gate arrays(s) (PGA), a field programmable gate array (FPGA), etc.

Also, the flow charts and diagrams of FIGS. 4 and 5 show the architecture, functionality, and operation of a possible implementation of the logic. In this regard, each block may represents a module, segment, or portion of code, which comprises one or more executable instructions for implementing the specified logical function(s). It should also be noted that in some alternative implementations, the functions noted in the blocks may occur out of the order noted in FIGS. For example two or more blocks shown in succession in FIGS. 4 and 5 may in fact be executed substantially concurrently or the blocks may sometimes be executed in the reverse order, depending upon the functionality involved.

While having described and illustrated the principles of the present invention with reference to various preferred embodiments and alternatives, it will be apparent to those familiar with the art that the invention can be further modified in arrangement and detail without departing from those principles. Accordingly, it is understood that the present invention includes all such modifications that come within the terms of the following claims and equivalents thereof.

What is claimed is:

1. A method for shredding documents rendering information contained in the documents unintelligible, comprising the steps of:

analyzing an image printed on a document to determine a desired cut pattern for the document;

adjusting one or more cutting devices in accordance with the desired cut pattern; and cutting the document into segments in accordance with the desired cut pattern.

2. A method for shredding documents rendering information contained in the documents unintelligible, comprising the steps of:

determining a desired cut pattern for a document;

responsive to a control signal, adjusting one or more cutting devices in accordance with the desired cut pattern; and cutting the document into segments in accordance with the desired cut pattern.

3. The method of claim 2 wherein the step of determining a desired cut pattern for a document includes the steps of:

providing an image of the information contained in the document; and processing the image in accordance with a predetermined set of rules to determine the desired cut pattern.

4. The method of claim 3 wherein the image of the information contained in the document comprises a digital image.

5. The method of claim 3 wherein the step of providing an image of the information contained in the document includes the steps of:

scanning the document; and storing the scanned image.

6. The method of claim 2 including the step of disposing of the cut segments of the document in a disposal bin.

7. The method of claim 2 wherein the one or more cutting devices comprises an adjustable document shredder.

8. The method of claim 2 wherein all cuts are in blank spaces on the document.

9. The method of claim 8 wherein no more than one cut per segment will traverse a mark on the document.

10. The method of claim 9 wherein the number of cuts traversing a mark on the document will not exceed a predetermined limit for each page of the document.

11. Apparatus for shredding a document rendering information contained in the document unintelligible, comprising:

a document reader for providing an image of the information contained in the document;

a processor coupled to the document reader for analyzing the image to determine a desired cut pattern; and a document shredder responsive to instructions generated by the processor for cutting the document into segments in accordance with the desired cut pattern.

12. Apparatus as in claim 11 further comprising an input tray for storing the document and for feeding pages of the document to the document reader.

13. Apparatus as in claim 12 further comprising an intermediate paper tray for receiving pages from the document reader after each page is read, and for subsequently feeding the read pages to the document shredder.

14. Apparatus as in claim 11 further comprising a shredder controller coupled to the processor and to the document shredder, responsive to instructions generated by the processor for controlling the document shredder.

15. Apparatus as in claim 14 wherein the document shredder includes adjustable cutting components responsive to cut control signals generated by the shredder controller to adjust the size and position of cuts in the document in accordance with the desired cut pattern.

16. Apparatus as in claim 14 wherein the shredder controller is coupled to a document input tray, the document input tray responsive to feed control signals generated by the shredder controller to feed pages of a document to the document reader and to the document shredder in a coordinated manner ensuring that the desired cut pattern for a page is determined prior to that page being cut into segments.

17. Apparatus as in claim 11 wherein the desired cut pattern is determined in accordance with a predetermined set of rules.

18. Apparatus as in claim 17 wherein all cuts made in accordance with the desired cut pattern are located in blank portions of the document.

19. Apparatus as in claim 17 wherein no more than one cut per segment traverses a mark on the document.

20. Apparatus as in claim 17 wherein the number of cuts traversing a mark on the document will not exceed a predetermined limit for each page of the document.

21. Apparatus as in claim 11 wherein the document reader comprises a scanner.

22. Apparatus as in claim 11 wherein the document shredder comprises a pair of cutter rotors for cutting the document into strips, each cutter rotor having a plurality of spaced first cutter blades mounted on a rotatively driven shaft, the spacing between the first cutter blades on each shaft being adjustable, each first cutter blade mounted on a first shaft being in opposing and slightly overlapping relationship end meshing with a corresponding first cutter blade mounted on a second shaft.

23. Apparatus as in claim 22 wherein the first cutter blades are slideably mounted on the shaft.

24. Apparatus as in claim 23 wherein the position of each of the first cutter blades on its respective shaft is individually adjustable by an electrical actuator.

25. Apparatus as in claim 23 wherein the position of opposing first cutter blades on their respective shafts is adjustable by an appropriate amount to ensure that the opposing first cutter blades mesh with each other and maintain an overlapping relationship.

26. Apparatus as in claim 22 wherein the spacing between the first cutter blades being adjustable responsive to control signals generated by a shredder controller to adjust the width of the strips and position of cuts in the document in accordance with the desired cut pattern.

27. Apparatus as in claim 22 wherein a paper path is defined through the document shredder, the paper path moving a document between the opposing first cutter blades, the document shredder further comprising at least one second cutter blade disposed in a plane generally normal to the paper path, the at least one second cutter blade for cutting the document generally transverse to the direction of flow of the paper path.

28. Apparatus as in claim 27 wherein the at least one second cutter blade is disposed downstream in the paper path of the pair of cutter rotors.

29. Apparatus as in claim 28 wherein the at least one second cutter blade cuts the strips into desired lengths, the desired length being a function of the speed of the document as it moves through the document shredder along the paper path.

30. Apparatus as in claim 29 further comprising a variable speed paper feed actuator responsive to control signals from a shredder controller for varying the speed of a document as it moves through the document shredder to adjust the length of the strips and position of cuts in the document in accordance with the desired cut pattern.

31. Apparatus as in claim 30 wherein the variable speed paper feed actuator comprises an electrical stepper motor.

32. Apparatus as in claim 27 wherein the at least one second cutter blade comprises at least one second cutter blade disposed for reciprocal motion on one side of the paper path, the at least one second cutter blade impacting a platen on the opposite side of the paper path.

33. Apparatus as in claim 27 wherein the at least one second cutter blade comprises at least one pair of second cutter blades, each second cutter blade of the at least one pair of second cutter blades disposed for reciprocal motion on a side of the paper path in opposing relationship with the other one second cutter blade, the at least one pair of opposing second cutter blades meshing and slightly overlapping at the paper path.

* * * * *

UNITED STATES PATENT AND TRADEMARK OFFICE

CERTIFICATE OF CORRECTION

PATENT NO. : 6,779,747 B2
DATED : September 28, 2004
INVENTOR(S) : Dean J. Richtsmeier It is certified that error appears in the above-identified patent and that said Letters Patent is hereby corrected as shown below:

Column 7,
Line 35, delete “determined” and insert therefor -- determine --
Line 44, delete “by” and insert therefor -- be --
Line 63, delete “them” and insert therefor -- then --

Column 8,
Line 66, delete “represents” and insert therefor -- represent --

Column 10,
Line 49, deltee “end” and insert therefor -- and --

Signed and Sealed this

Twenty-ninth Day of March, 2005

JON W. DUDAS
*Director of the United States Patent and Trademark Office*